US006685545B2

(12) United States Patent
Chuang

(10) Patent No.: US 6,685,545 B2
(45) Date of Patent: Feb. 3, 2004

(54) ROLLER SWAYING DEVICE FOR AN EMERY BELT MACHINE

(76) Inventor: Bor Yann Chuang, No. 78, Yungfeng Rd., Taiping Shiang, Taichung (TW), 411

( * ) Notice: Subject to any disclaimer, the term of this patent is extended or adjusted under 35 U.S.C. 154(b) by 133 days.

(21) Appl. No.: 10/001,821

(22) Filed: Dec. 5, 2001

(65) Prior Publication Data

US 2003/0104772 A1 Jun. 5, 2003

(51) Int. Cl.[7] ..... B24B 7/06
(52) U.S. Cl. ..... 451/155; 451/157; 451/358
(58) Field of Search ..... 451/155, 157, 451/241, 245, 358, 304

(56) References Cited

U.S. PATENT DOCUMENTS

| | | | | | |
|---|---|---|---|---|---|
| 335,117 | A | * | 2/1886 | Elmer et al. | 451/357 |
| 357,975 | A | * | 2/1887 | Burton | 451/357 |
| 532,348 | A | * | 1/1895 | Taylor et al. | 451/357 |
| 743,911 | A | * | 11/1903 | Muller | 451/353 |
| 5,531,636 | A | * | 7/1996 | Bissen | 451/130 |

FOREIGN PATENT DOCUMENTS

| | | | | |
|---|---|---|---|---|
| AT | 057972 | * | 3/1913 | 451/157 |
| DE | 327525 | * | 10/1920 | 451/155 |
| GB | 021958 | * | of 1912 | 451/155 |

* cited by examiner

*Primary Examiner*—Robert A. Rose
(74) *Attorney, Agent, or Firm*—Troxell Law Office PLLC

(57) ABSTRACT

A roller swaying device for an emery belt machine includes a machine body provided with a machine base on top, two rollers respectively having its support shaft axially pivoted with the groove hole of the machine base, and a fit device provided at a preset position in the machine base and having a belt wheel capable to be activated to rotate and a shaft hole for receiving and activating the support shaft to rotate and move transversely there in. Besides, a swing device is fitted at a preset position in the machine body and has a swaying connecting rod capable to make the support shaft and the roller move to and fro transversely, obtaining a comparatively good grinding effect.

5 Claims, 6 Drawing Sheets

ROLLER SWAYING DEVICE FOR AN EMERY BELT MACHINE

BACKGROUND OF THE INVENTION

This invention relates to a roller swaying device for an emery belt machine, particularly to one capable to make the rollers of the emery belts rotate and swing to and fro transversely as well, possible to let the surface of an article ground comparatively smooth.

A conventional emery belt machine has a motor for rotating a roller, which drives the emery belt forward to carry on grinding. However, in such a conventional way, the emery belt can move only in one direction for grinding so that the article being processed can hardly be ground completely to make its surface shiny and smooth. Besides, if there are any projections on the surface of an article being ground, part of the emery belt is likely to be damaged, and if this damaged part of the emery belt is not taken care of, the article afterward cannot be ground smoothly at the same position.

SUMMARY OF THE INVENTION

The objective of the invention is to offer a roller swaying device for an emery belt machine, capable to make the rollers rotate and also swing back and forth transversely, achieving a comparatively good grinding effect and reducing damage to a certain part of the emery belt.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
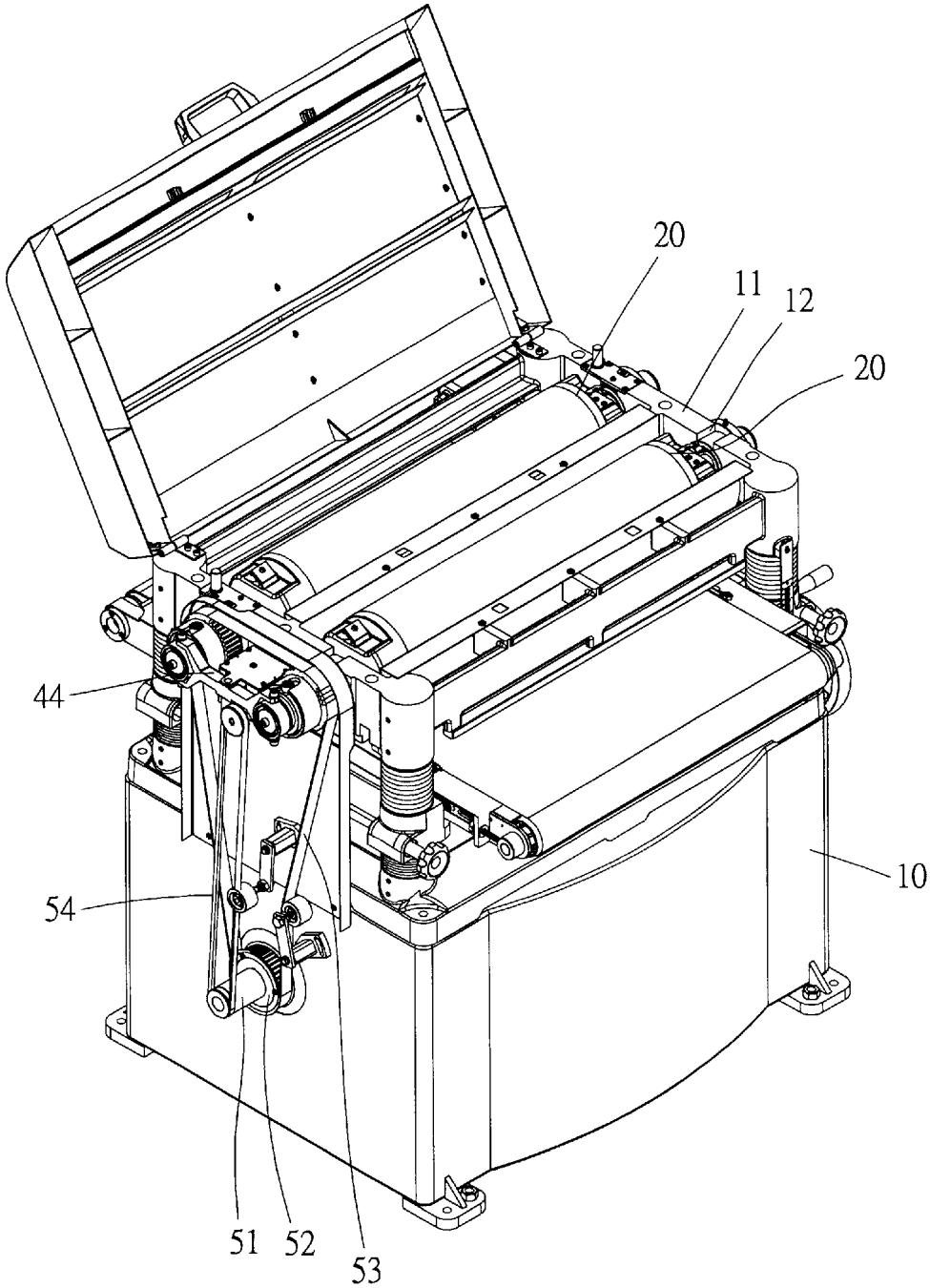
FIG. 1 is a perspective view of an emery belt machine with a roller swaying device in the present invention.

A preferred embodiment of a roller swaying device for an emery belt machine in the present invention includes a machine body 1, two rollers 20, a fit member 30, a swaying device 40 and a motor 50 as main components combined together.

The machine body 10, as shown in FIG. 1, is provided on top with a machine base 11 having two groove holes 12 correspondingly and respectively formed at opposite sides.

Figure 2:
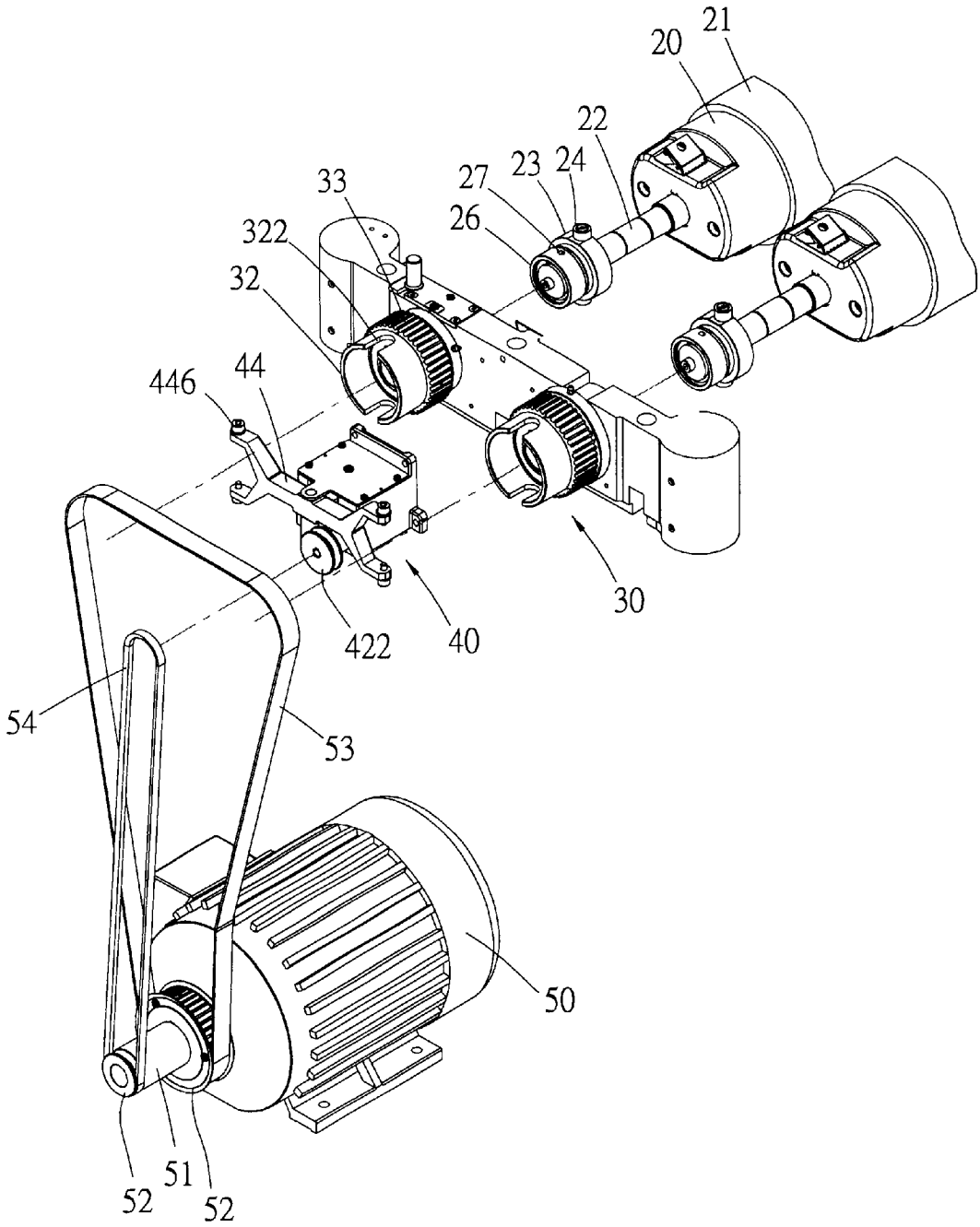
FIG. 2 is a partially exploded perspective view of a transmission device in the present invention.
Figure 3:
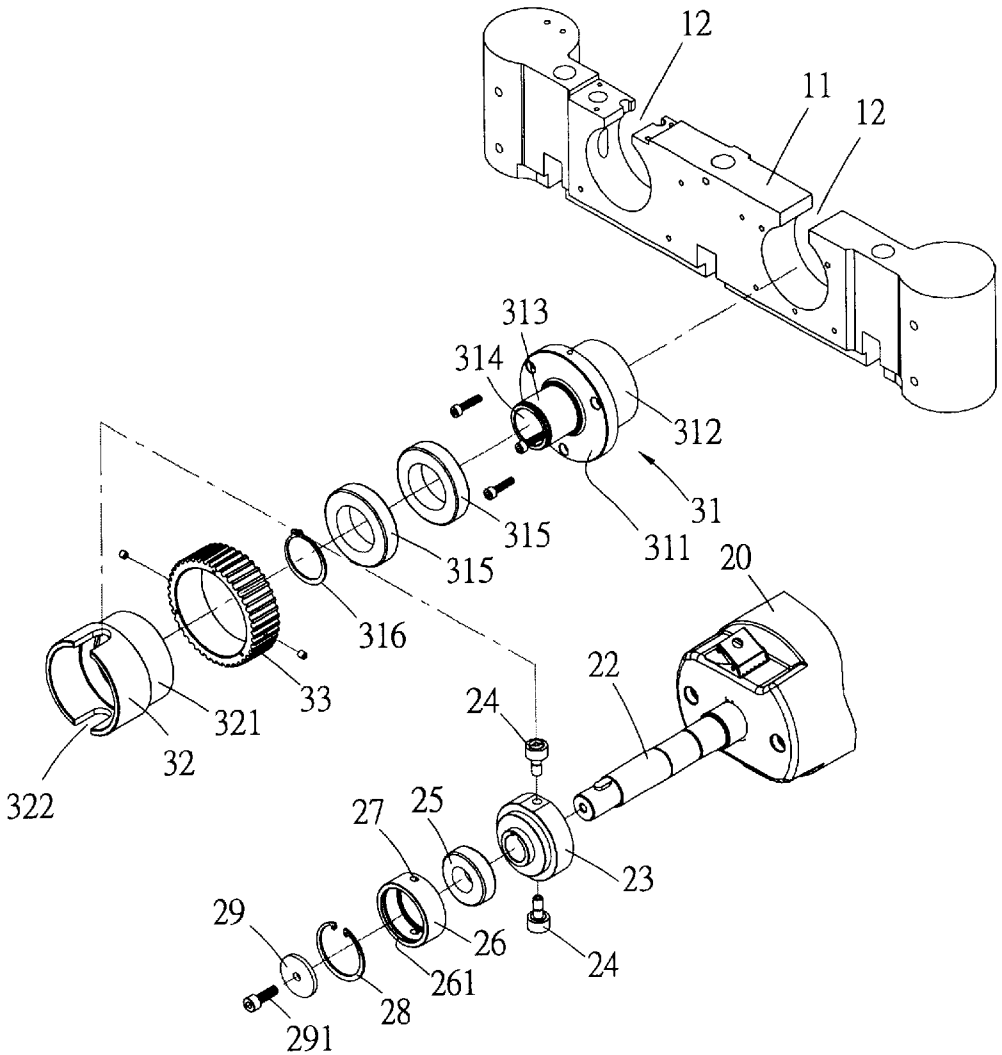
FIG. 3 is a partially exploded perspective view of a fit device in the present invention.
Figure 4:
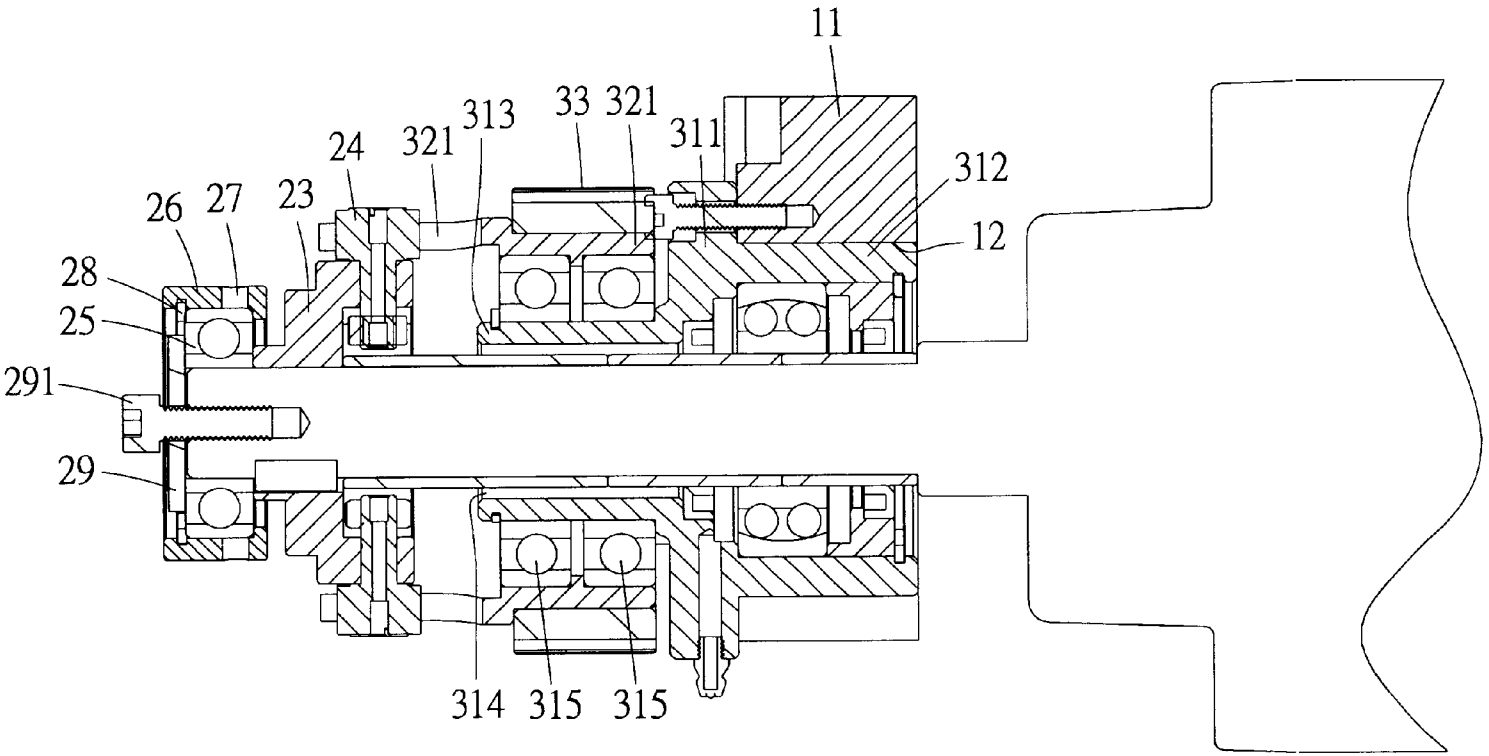
FIG. 4 is a cross-sectional view of the fit device assembled in the present invention.

Two rollers 20, as shown in FIGS. 2 and 3, are respectively wrapped with an emery cloth 21 around the surface and respectively fitted with a support shaft 22 at one side. Each support shaft 22 has a push wheel 23 fixed near the end of the left portion, and each push wheel 23 has two guide pins 24 provided respectively on top and at the bottom. The guide pins 24 can be fitted around with a rotatable sleeve or bearing to rotate therein. Besides, the support shaft 22 has its end first fixed with a bearing 25 and then fitted around pivotally with a toggle 26 having two insert holes 27 formed respectively on top and at the bottom, as shown in FIGS. 3 and 4. The toggle 26 is formed with an annular groove 261 around the inner wall of its front end for a helical spring washer 28 to be fitted therein, and is fastened in place around the end of the support shaft 22 by means of a protective cover 29 and a screw 291, with the toggle 26 and the support shaft 22 capable to rotate with each other.

The fit device 30 is composed of a sleeve head 31, a transmission shaft sleeve 32 and a belt wheel 33. The sleeve head 31, as shown in FIGS. 3 and 4, has a combining plate 311 provided around the center portion to be assembled on the outward side of the groove hole 12 of the machine base 11, and a connecting tube 312 formed on the inner side to be received in the groove hole 12 of the machine base 11. Further, a hollow shaft 313 is provided on the outward side of the sleeve head 31, having its interior shaft hole 314 receiving the support shaft 22, and its outer rim first fitted around with two bearings 315 and then fixed by a retainer 316.

The transmission shaft sleeve 32 is formed with a sleeve 321 of a relatively small diameter, and the sleeve 321 has its interior fixedly fitted with two bearings 315 and its outer rim received in a belt wheel 33. In addition, the transmission shaft sleeve 32 has two sliding grooves 322 formed respectively on top and at the bottom, with the opening of each sliding groove 322 facing outward for the guide pin 24 of the push wheel 23 to slide therein.

In assembling, the fit device 30 is first assembled on the outer side of the groove hole 12 of the machine base 11, then the support shaft 22 is inserted in the fit device 30 and finally the push wheel 23 of the support shaft 22 is fitted in the transmission shaft sleeve 32, letting the two guide pins 24 of the push wheel 23 respectively positioned in the slide grooves 322 of the transmission shaft sleeve 32.

Figure 5:
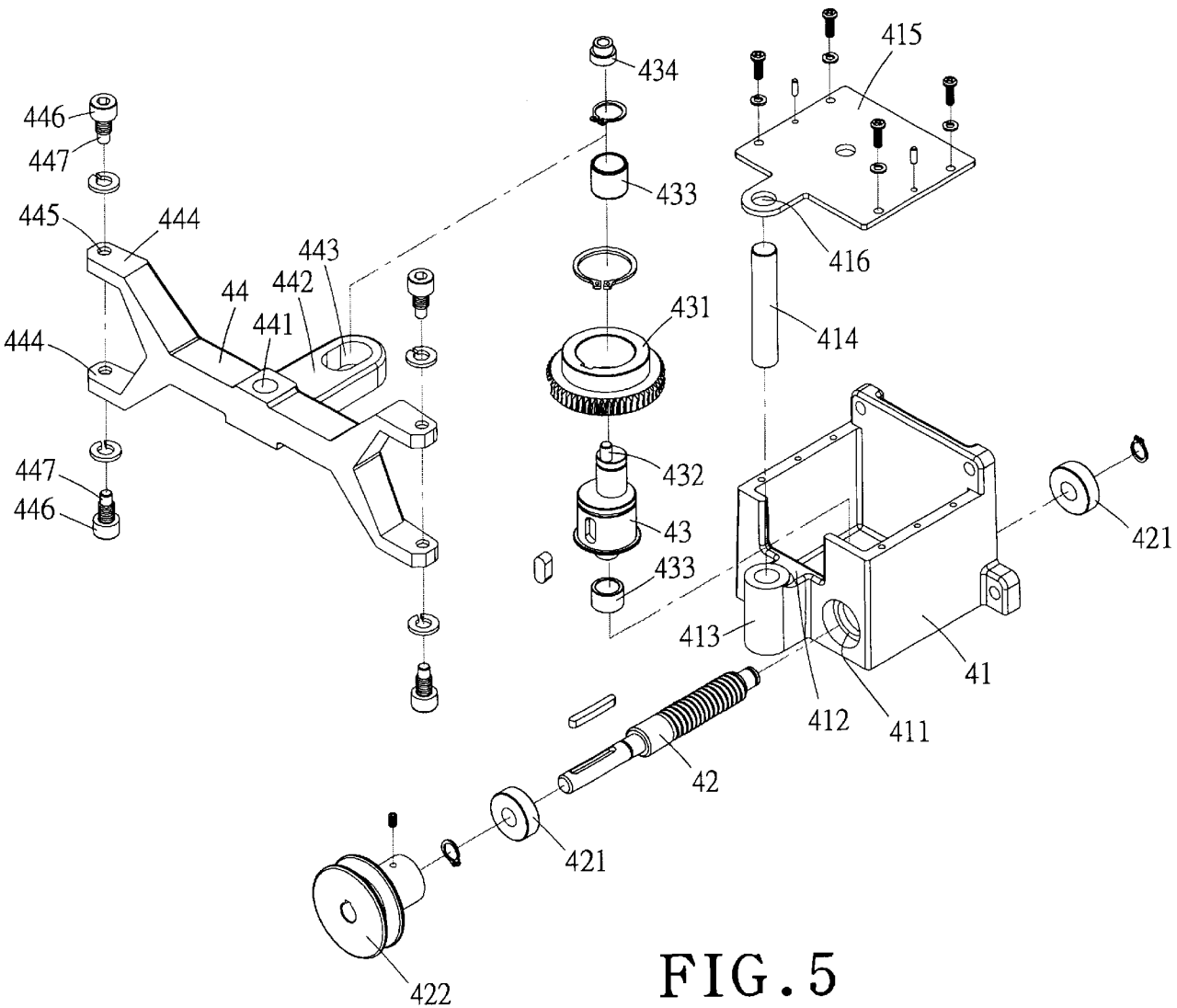
FIG. 5 is an exploded perspective view of a swaying device of the emery belt machine in the present invention.

The swaying device 40, as shown in FIG. 5, includes a machine box 41, a worm 42, a guiding post 43 and a swaying rod 41. The machine box 41 has a through hole 411 at a lower right side and a cut groove 412 at a front side. The cut groove 412 is provided with a shaft base 413 at a lower portion of the outer side, and the shaft base 413 is fitted inside with a vertical support shaft 414 having its top end received in the side hole 416 of an upper cover 415.

The worm 42 is fitted in the through hole 411 of the machine box 41 and fixed in place by two bearings 421 on opposite ends, and has a belt wheel 422 fixed at the front end.

The guiding post 43 is axially connected with one side of the worm 42 inside the machine box 41 and fixed with a worm wheel 431 around its outer rim for meshing with the worm 42 and rotating together. The guiding post 43 is further provided with an eccentric wheel 432 on top, and fixed in place by means of two inner rings 433 and a lining sleeve 434.

The swaying connecting rod 44 is T-shaped and has a shaft hole 441 in the center for receiving the vertical support shaft 414. The swaying connecting rod 44 is further provided with an actuating arm 442 protruding forward from a center portion. The actuating arm 442 has an oval stirring groove 443 at an end for receiving the eccentric shaft 432 of the guide post 43 so as to let the swaying connecting rod 44 activated to sway back and forth transversely within a preset range with the shaft hole 441 serving as a center of circle when the eccentric shaft 432 rotates eccentrically. Besides, the swaying connecting rod 44 has a pair of stirring rods 444 formed spaced apart in parallel at opposite ends, with each stirring rod 444 having a threaded hole 445 for a fastener 446 to screw therein. The fastener 446 is formed with a pin 447 at the bottom end to be inserted in the insert hole 27 of the toggle 26 at the end of the support shaft 22.

Figure 6:
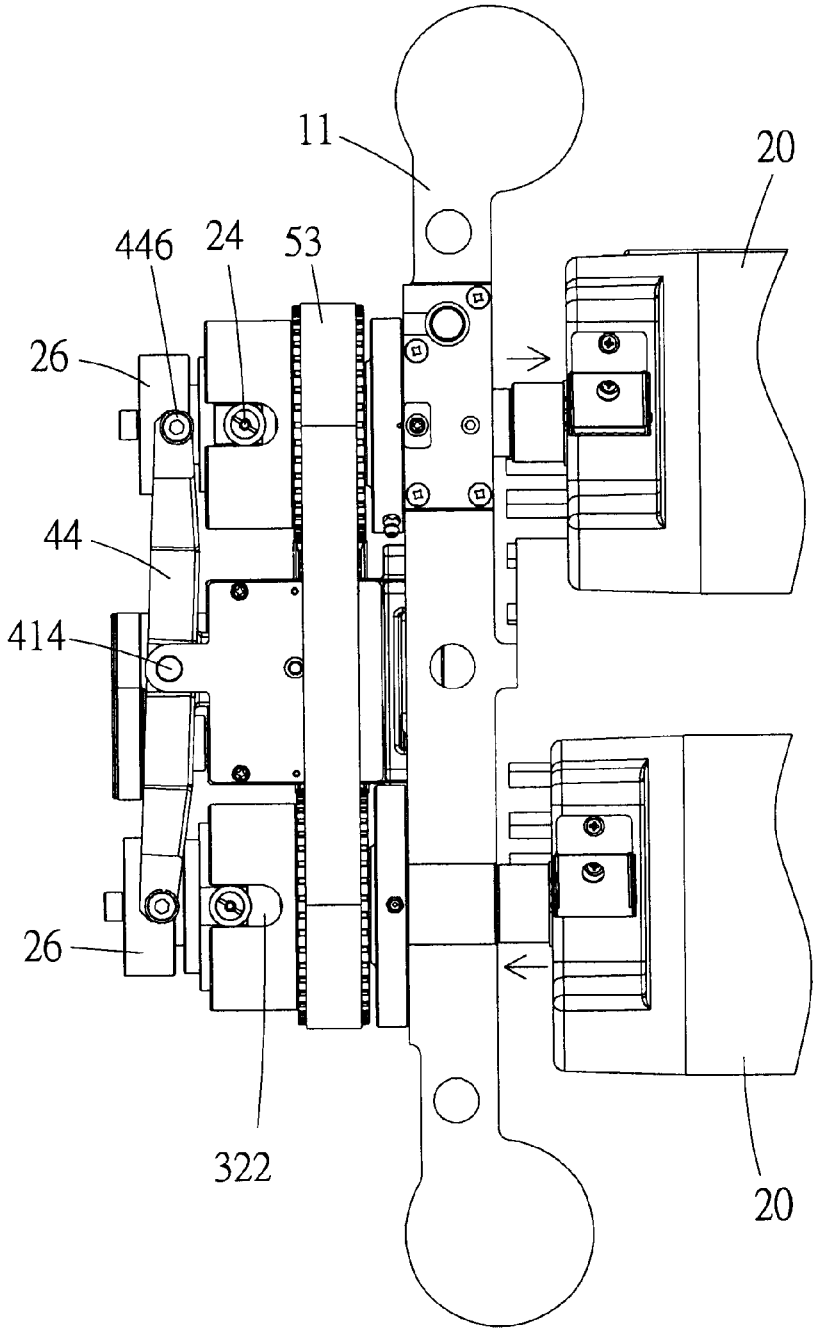
FIG. 6 is a cross-sectional view of the swaying device in a swaying condition in the present invention.

The motor 50, as shown in FIGS. 1 and 2, is provided with a drive shaft 51 having two belt wheels 52 respectively driving a first belt 53 and a second belt 54. The first belt 53 is provided to drive the belt wheel 33 of the fit device 30 to let the transmission shaft sleeve 32 rotate, and at the same time, the sliding grooves 322 of the transmission shaft sleeve 32 will activate the guide pins 24 and the support shaft 22 to rotate together with two rollers 20 and the emery cloth 21 around their outer rims. The second belt 54 is provided to drive the belt wheel 422 of the swaying device 40 to let the worm 42 and the worm wheel 431 rotate together with the guiding post 42 and its eccentric shaft 432. When the eccentric shaft 432 is actuated to rotate eccentrically, the swaying connecting rod 44 will be forced to sway back and forth transversely within a preset range, as shown in FIG. 6.

Next, the pins 447 of the stirring rods 444 are respectively inserted in the insert holes 27 of the toggle 26 at the end of the support shaft 22 to permit the support shaft 22 and the rollers 20 move back and forth transversely. The guide pin 24 of the support shaft 22 is capable to slide transversely in the sliding groove 322 of the fit device 31, therefore the belt wheel 33 can smoothly activate the guide pin 24 and the support shaft 22 to rotate by means of the sliding groove 322 of the transmission shaft sleeve 32.

Furthermore, the insert pin 447 of the swaying connecting rod 44 is inserted in the insert hole 27 of the toggle 26 fixed around the support shaft 22, so when the swaying connecting rod 44 is forced to sway transversely, the support shaft 22 will move transversely and rotate freely in its bearing 25 as well.

As can be understood from the above description, this invention has the following advantages.

1. The two rollers 20 and the emery cloth 21 fixed on their outer rims can not only be driven to rotate but also activated to move to and fro transversely. Thus, in case a certain part of the emery cloth 21 is imperfect, this imperfect portion will not keep on grinding at the same position of a wood material being processed, achieving a relatively good grinding effect.

2. The transversely moving distance of the rollers 20 can be set according to practical requirements. Generally speaking, a grinding effect can be elevated so long as the rollers are shifted a bit, with the shifting distance of the rollers preferably set between 10 mm and 20 mm.

3. The independent driving of the swaying device 40 and a way of linear sliding enable two rollers 20 to move transversely, smooth in actuating, and easy in repairing and maintenance.

While the preferred embodiment has been described above, it will be recognized and understood that various modifications may be made therein and the appended claims are intended to cover all such modifications that may fall within the spirit and scope of the invention.

I claim:

1. A roller swaying device for an emery belt machine comprising: a machine body with a top and opposite sides provided with a machine base on the top, said machine base having two groove holes correspondingly formed on the opposite sides and two rollers with a support shaft pivotally located in said groove holes of said machine base; and a fit device and a swaying device, said fit device positioned at a preset location of said machine base and having a belt wheel activated to rotate, said fit device further having a shaft hole inside for said support shaft to insert therein, said shaft hole activating said support shaft to rotate and move transversely therein, said swaying device provided at a preset position in said machine body and having a T-shaped swaying connection rod capable to make said support shaft and said rollers move back and forth transversely, wherein said support shaft is provided at a preset position with a push wheel having two guide pins fixed respectively on top and at the bottom, and said fit device is further provided with a transmission shaft sleeve having two sliding grooves respectively formed at the upper and lower end for said guide pins of said push wheel to slide therein.

2. A roller swaying device for an emery belt machine comprising: a machine body with a top and opposite sides provided with a machine base on the top, said machine base having two groove holes correspondingly formed on the opposite sides and two rollers with a support shaft pivotally located in said groove holes of said machine base; and a fit device and a swaying device, said fit device positioned at a preset location of said machine base and having a belt wheel activated to rotate, said fit device further having a shaft hole inside for said support shaft to insert therein, said shaft hole activating said support shaft to rotate and move transversely therein, said swaying device provided at a preset position in said machine body and having a T-shaped swaying connection rod capable to make said support shaft and said rollers move back and forth transversely, wherein said fit device is provided with a sleeve head and a hollow shaft, said sleeve head having a connecting tube on the inner side to be fixed in said groove hole of said machine base, and said hollow shaft positioned on the outward side with its outer rim secured around with two bearings, said transmission shaft sleeve formed at the inward side with a sleeve with a relatively small diameter, said sleeve having its interior fitted with two said bearings and its outer rim fixed with said belt wheel.

3. A roller swaying device for an emery belt machine comprising: a machine body with a top and opposite sides provided with a machine base on the top, said machine base having two groove holes correspondingly formed on the opposite sides and two rollers with a support shaft pivotally located in said groove holes of said machine base; and a fit device and a swaying device, said fit device positioned at a preset location of said machine base and having a belt wheel activated to rotate, said fit device further having a shaft hole inside for said support shaft to insert therein, said shaft hole activating said support shaft to rotate and move transversely therein, said swaying device provided at a preset position in said machine body and having a T-shaped swaying connection rod capable to make said support shaft and said rollers move back and forth transversely, wherein said support shaft has its end first fixed around with a bearing and then pivotally fitted with a toggle having two insert holes formed respectively on top and at the bottom.

4. A roller swaying device for an emery belt machine comprising: a machine body with a top and opposite sides provided with a machine base on the top, said machine base having two groove holes correspondingly formed on the opposite sides and two rollers with a support shaft pivotally located in said groove holes of said machine base; and a fit device and a swaying device, said fit device positioned at a preset location of said machine base and having a belt wheel activated to rotate, said fit device further having a shaft hole inside for said support shaft to insert therein, said shaft hole activating said support shaft to rotate and move transversely therein, said swaying device provided at a preset position in said machine body and having a T-shaped swaying connection rod capable to make said support shaft and said rollers move back and forth transversely, wherein said swaying device further has a guiding post and a T-shaped swaying connecting rod, said guiding post axially fitted inside the machine box to be activated to rotate therein and having an eccentric shaft secured on top, said T-shaped swaying connecting rod axially pivoted at a proper position and having an actuating arm on an inward center portion with an oval stirring groove at the end for receiving said eccentric shaft of said guiding post.

5. A roller swaying device for an emery belt machine comprising: a machine body with a top and opposite sides provided with a machine base on the top, said machine base having two groove holes correspondingly formed on the opposite sides and two rollers with a support shaft pivotally located in said groove holes of said machine base; and a fit device and a swaying device, said fit device positioned at a preset location of said machine base and having a belt wheel activated to rotate, said fit device further having a shaft hole inside for said support shaft to insert therein, said shaft hole activating said support shaft to rotate and move transversely therein, said swaying device provided at a preset position in said machine body and having a T-shaped swaying connection rod capable to make said support shaft and said rollers move back and forth transversely, wherein said swing connecting rod has a pair of stirring rods formed spaced apart in parallel and respectively positioned at opposite ends, with each said stirring rod having a threaded hole for a fastener to screw therein, each said fastener having its bottom end formed with a pin to be inserted in said insert hole of said toggle at the end of said support shaft.

* * * * *